United States Patent [19]

Pedersen

[11] 4,126,968

[45] Nov. 28, 1978

[54] GRINDING DEVICE FOR GATE VALVES

[76] Inventor: Jan Pedersen, Ekholtveien 71 a, 1500 Moss, Norway

[21] Appl. No.: 812,281

[22] Filed: Jul. 1, 1977

[51] Int. Cl.[2] ..... B24B 19/00

[52] U.S. Cl. ..... 51/241 VS

[58] Field of Search ..... 51/241 VS, 245

[56] References Cited

U.S. PATENT DOCUMENTS 2,360,009 10/1944 Norton ..... 51/241 VS

FOREIGN PATENT DOCUMENTS 801,894 1/1951 Fed. Rep. of Germany ..... 51/241 VS
891,213 9/1953 Fed. Rep. of Germany ..... 51/241 VS
84,764 10/1954 Norway ..... 51/241 VS

*Primary Examiner*—Harold D. Whitehead

*Assistant Examiner*—Roscoe V. Parker

*Attorney, Agent, or Firm*—Ladas, Parry, Von Gehr, Goldsmith & Deschamps

[57] ABSTRACT

A grinding device for gate valves which can be attached in a simple manner to the interior of a valve seat. The valve can by a simple rotation back and forth of the grinding device, e.g. by means of cord drive, be ground very accurately by hand. By adjusting press members provided on the device, the grinding ring can also be made to press with varying degrees of force against the respective parts of the valve, such that the grinding effect can be regulated. Because the grinding ring is designed to use removable abrasive paper, it is also very simple first to carry out a rough grinding and thereafter to perform fine grinding. Adaptation of the device to valves of different sizes is simplified.

6 Claims, 5 Drawing Figures

GRINDING DEVICE FOR GATE VALVES

The invention relates to a grinding device for gate valves.

In grinding gate valves, one encounters the problem that the valves are usually not easily accessible. Previously, the valves have been ground by hand, but the result has thus been extremely inaccurate. In addition, driven grinding devices are known which are guided down to the gate valve, but such devices are relatively complex and expensive owing to the number of power transmission connections required. Because of the relatively complex construction of such devices, it is also difficult to accomplish the grinding with sufficient accuracy. The most common practice, therefore has been to dismantle the whole valve in order to make it more easily accessible.

The object of the present invention is to provide a simple and inexpensive grinding device which can be mounted on the valve in a practical manner and which provides more accurate grinding than the known to date. The device is also made such that it can easily be adapted to different sizes of valves.

This purpose is achieved by a grinding device having the characterizing feature outlined in the claims.

The grinding device can thus be attached in a simple manner to the interior of the valve seat, and by a simple rotation back and forth, e.g. by means of cord drive, the valve can be ground very accurately by hand. By adjusting press members provided on the device, the grinding ring can also be made to press with varying degrees of force against the respective parts of the valve, such that the grinding effect can be regulated. Because the grinding ring is designed to use removable abrasive paper, it is also very simple first to carry out a rough grinding and thereafter to perform fine grinding. Adaptation of the device to valves of different sizes is simplified, because one need only change the grinding ring and plate, which are simple and inexpensive parts to make, in order to adapt the device to any desired size. For use on board a ship, for example, the device can be delivered with a set of grinding rings and plates which are adapted to the gate valves in use on the ship. Grinding with abrasive paper also has the advantage that sparks will not have created.

Figure 1:
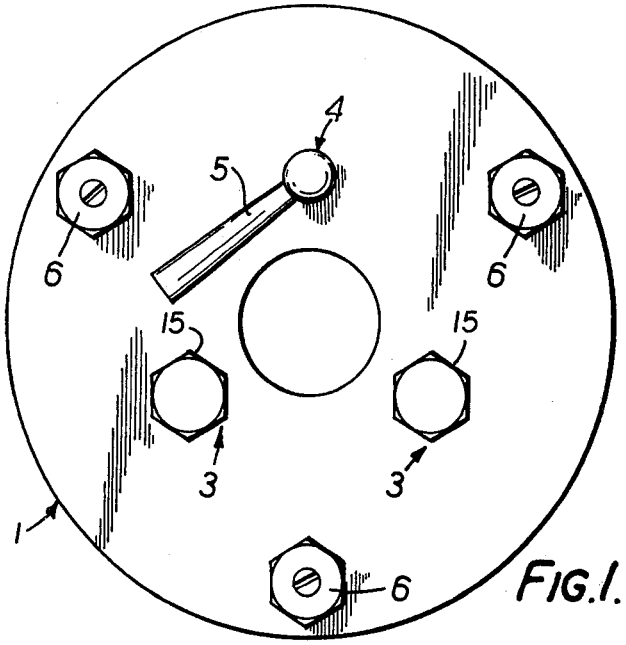
Figure 2:
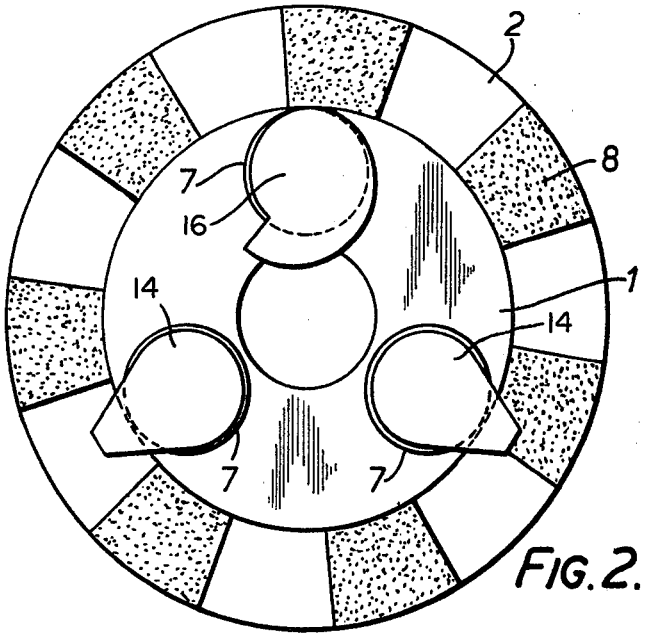
Figure 3:
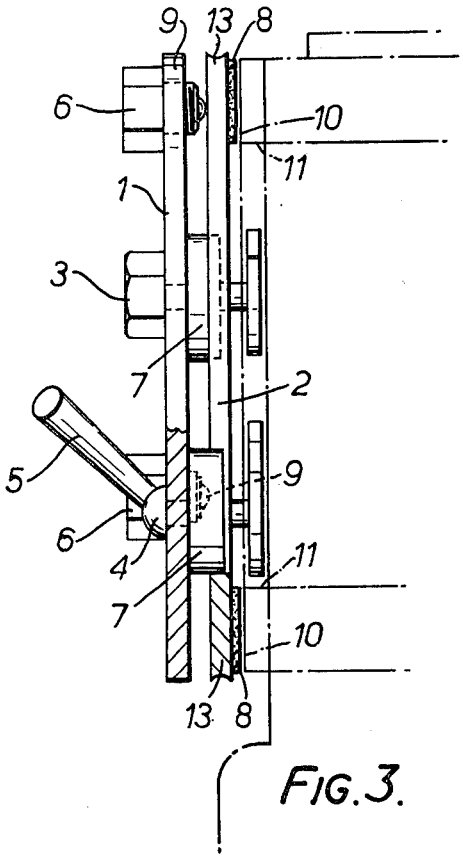
Figure 4:
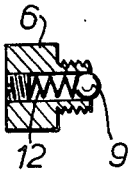
Figure 5:
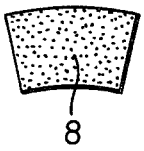

The invention will be explained in more detail in the following with reference to an embodiment illustrated in the Figures:

FIG. 1 is a vertical projection of the device of the invention as seen from the plate side, FIG. 2 is a vertical projection of the device of FIG. 1, as seen from the grinding ring side, FIG. 3 is a side view of the device of FIGS. 1 and 2, FIG. 4 shows one of the press members of the grinding device, and FIG. 5 shows a piece of abrasive paper for attachment on the grinding ring.

The device illustrated in the drawings comprises a plate 1, which constitutes the base plate of the device. In the embodiment example shown here, the plate is circular in shape, and has approximately the same diameter as the gate valve which is to be ground. The plate 1 is provided with two fasteners 3 having respective catch members 14, and with an adjustable fastener 4 having an eccentric catch member 16 and an operating handle 5. A grinding ring 2 is disposed between the plate 1 and the catch members 14 and 16. The catch members 14 can be arranged so that they project radially of the plate 1 and somewhat beyond the inner periphery of the grinding ring, and can be locked in this position by means of nuts 15. The fasteners 3 and 4 each have a journal shaft extending from the catch member and through the plate 1, and respective bearings, (in the example illustrated, ball bearings), are arranged on these shafts and form a support surface for the grinding ring. The grinding ring can rotate on the bearings 7.

The catch members are rotatable about respective axes which are perpendicular to the plane of the plate 1, as seen in FIG. 3. As clearly shown in FIG. 2, the catch member 16 has a peripheral surface the distance of which from the axis of rotation of the catch member increases in the clockwise direction about a substantial part of the periphery of the catch member.

In the region overlying the grinding ring, the plate 1 is also provided with three press members 6 in the form of threaded bolts. As can be seen on FIGS. 3 and 4, these bolts are provided with a rotatable ball 9 on the end facing the grinding ring 2, said ball 9 being in contact with the grinding ring and pressing it against the valve which is to be ground. As shown on FIG. 4, the balls can be spring-loaded by a spring 12 positioned inside the threaded bolt 6.

A suitable abrasive paper is applied to the grinding ring 2, preferably in the form of discrete pieces of abrasive paper 8, self-adhesive on the back side, thus permitting the abrasive paper to be easily attached to the grinding ring, and easily removed if one wishes to substitute a finer-grade paper or to replace abrasive paper which has become worn down during use.

When a gate valve is to be ground, the plate 1 with its grinding ring 2 in place is guided down to a valve, indicated on FIG. 3 by the stippled lines. The grinding device is positioned in the valve such that the catch members 14 are touching the interior surface 11 of the valve seat, while the catch member 16 is rotated such that its peripheral surface edge projects outwardly as little as possible. The operating handle 5 is subsequently turned in the counterclockwise direction (as seen in FIG. 2), causing the catch member 16 to rotate into engagement with the interior surface 11 of the valve seat. Owing to the configuration of its peripheral surface, the catch member 16 thereby locks the grinding device in place. A cord is then placed in a circumferential groove 13 on the grinding ring 2, and the grinding ring is rotated back and forth by pulling on the cord. Owing to the back-and-forth movement of the grinding ring, the abrassive paper 8 will grind the valve. If one wishes to exert a stronger grinding pressure on the upper side of the valve than on the lower side, one may tighten the press members on the upper side of the device accordingly.

Having described my invention, I claim:

1. A grinding device for a gate valve which has a seat formed by an end surface of a generally cylindrical member having an interior space which is bounded by an interior surface thereof, the grinding device comprising a mounting plate, a grinding ring rotatably disposed on the mounting plate, and a plurality of fastening mechanisms secured to the plate and each having a catch member which is spaced from the mounting plate, the grinding ring being disposed between the mounting plate and the catch members, the catch members being adapted to be disposed in use within the interior space of the generally cylindrical member, and at least one of the catch members being rotatable about a predetermined axis and having a peripheral surface the distance of which from said axis increases in one angular direction about said axis, so that by rotating said one catch member in the direction opposite to said one direction when the catch members are disposed within the interior space of the generally cylindrical member the catch members can be brought into locking engagement with the interior surface of the generally cylindrical member, and the device further comprising a plurality of pressing members distributed around the circumference of the mounting plate for pressing the grinding ring towards the valve seat, each pressing member comprising a bolt having an end which faces towards the grinding ring and is provided with a rotatable ball.

2. A device as claimed in claim 1, wherein the ball of each pressing member is spring loaded.

3. A device as claimed in claim 1, wherein each fastening mechanism is provided with a bearing, the grinding ring being supported on said bearings.

4. A device as claimed in claim 1, wherein the grinding ring has a groove around its outer periphery for holding a cord.

5. A device as claimed in claim 1, wherein said predetermined axis extends perpendicular to said mounting plate.

6. A device as claimed in claim 5, wherein the fastening mechanism having said one catch member is provided with an operating handle which is disposed at the opposite side of said mounting plate from said grinding ring and said catch members, said operating handle being connected to said one catch member to rotate said one catch member about said predetermined axis.

* * * * *